US009920974B2

(12) United States Patent
Langenberg et al.

(10) Patent No.: US 9,920,974 B2
(45) Date of Patent: Mar. 20, 2018

(54) METHOD FOR CONTROLLING DEFROST OPERATION OF A REFRIGERATION SYSTEM

(75) Inventors: Gero C. Langenberg, Flensburg (DE); Hans Erik Fogh, Broager (DK)

(73) Assignee: Danfoss A/S, Nordborg (DK)

( * ) Notice: Subject to any disclaimer, the term of this patent is extended or adjusted under 35 U.S.C. 154(b) by 938 days.

(21) Appl. No.: 14/232,306

(22) PCT Filed: Jul. 13, 2012

(86) PCT No.: PCT/DK2012/000083
§ 371 (c)(1),
(2), (4) Date: Jan. 13, 2014

(87) PCT Pub. No.: WO2013/010539
PCT Pub. Date: Jan. 24, 2013

(65) Prior Publication Data

US 2014/0165630 A1 Jun. 19, 2014

(30) Foreign Application Priority Data

Jul. 15, 2011 (DK) ..... 2011 00548

(51) Int. Cl.
*F25D 21/00* (2006.01)

(52) U.S. Cl.
CPC ..... *F25D 21/004* (2013.01); *F25D 21/006* (2013.01); *F25B 2500/26* (2013.01); *F25B 2500/27* (2013.01); *F25B 2700/2115* (2013.01)

(58) Field of Classification Search
CPC ..... F25D 21/004; F25D 21/006; F25D 2700/2115; F25B 2500/26
See application file for complete search history.

(56) References Cited

U.S. PATENT DOCUMENTS 4,197,717 A * 4/1980 Schumacher ..... F25D 21/002 62/213
4,528,821 A 7/1985 Tershak et al.
(Continued)

FOREIGN PATENT DOCUMENTS

CN 100545777 C 9/2009
EP 0090431 A2 3/1983
(Continued)

OTHER PUBLICATIONS

Danish Search Report Serial No. PA201100548 dated Feb. 9, 2012.
(Continued)

*Primary Examiner* — Kun Kai Ma
(74) *Attorney, Agent, or Firm* — McCormick, Paulding & Huber LLP

(57) ABSTRACT

The invention relates to a method for controlling a refrigeration system by establishing a defrost period during an initial defrost period. One or more compressors of the refrigeration system are monitored to establish if the one or more compressors are running, and a parameter representative of the one or more compressors running is monitored. The monitoring establishes at least one parameter limit value representative of whether a defrost period or a non-defrost period is to be initiated. The invention also relates to a method for controlling a refrigeration system subsequent to an electrical power interruption. The invention also relates to control units for applying one or both of the methods according to the invention, and to a refrigeration system having one or more control units controlling the refrigeration system according to one or both of the methods.

5 Claims, 4 Drawing Sheets

(56) References Cited

U.S. PATENT DOCUMENTS 4,535,599 A * 8/1985 Besson ..... F25D 21/002 62/154
4,852,360 A 8/1989 Harshbarger, Jr. et al.
4,932,217 A * 6/1990 Meyer ..... F25D 21/002 219/492
5,228,300 A * 7/1993 Shim ..... F25D 21/006 62/131
5,231,844 A * 8/1993 Park ..... F25D 21/002 62/153
5,493,867 A * 2/1996 Szynal ..... F25D 21/002 62/155
5,512,883 A 4/1996 Lane, Jr.
5,515,689 A * 5/1996 Atterbury ..... F25D 21/006 62/155
5,564,286 A * 10/1996 Suse ..... F25D 21/006 62/153
5,765,382 A * 6/1998 Manning ..... F25D 21/006 62/154
5,806,321 A * 9/1998 Bendtsen ..... F25D 21/008 62/155
5,842,355 A * 12/1998 Kalis ..... F25D 17/062 62/127
5,924,297 A * 7/1999 Wolff ..... A47F 3/0456 62/152
7,822,503 B2 10/2010 Merwarth et al.
2002/0083724 A1 7/2002 Tarlow et al.
2002/0088238 A1* 7/2002 Holmes ..... F25D 21/006 62/155
2002/0139130 A1* 10/2002 Collins ..... F25D 21/08 62/155
2002/0139132 A1* 10/2002 Collins ..... F25D 21/006 62/156
2003/0140639 A1* 7/2003 Gray ..... F25D 21/002 62/157
2004/0000154 A1 1/2004 Schanin
2004/0050075 A1 3/2004 King et al.
2004/0244389 A1* 12/2004 Denvir ..... F25D 21/002 62/156
2005/0177282 A1 8/2005 Mason, II
2007/0125103 A1* 6/2007 Lee ..... F25D 21/008 62/154
2007/0295015 A1* 12/2007 Bailey ..... F25D 21/006 62/150
2009/0051486 A1 2/2009 Denison et al.
2012/0198863 A1* 8/2012 Hall ..... F25D 21/006 62/80
2013/0174872 A1* 7/2013 Holbrook, Jr. ..... D06F 33/02 134/19
2014/0123690 A1* 5/2014 Hanley ..... F25D 21/006 62/80

FOREIGN PATENT DOCUMENTS

EP 1909050 A1 9/2006
WO 0190668 A1 11/2001

OTHER PUBLICATIONS

Danish Search Report Serial No. PA201100545 dated Feb. 3, 2012.
International Search Report for PCT Serial No. PCT/DK2012/000083 dated Jan. 17, 2014.

* cited by examiner

METHOD FOR CONTROLLING DEFROST OPERATION OF A REFRIGERATION SYSTEM

CROSS REFERENCE TO RELATED APPLICATIONS

This application is entitled to the benefit of and incorporates by reference subject matter disclosed in International Patent Application No. PCT/DK2012/000083 filed on Jul. 13, 2012 and Danish Patent Application No. PA 2011 00548 filed Jul. 15, 2011.

FIELD OF THE INVENTION

The invention relates to a method of controlling defrost operation of a refrigeration system. Defrost of refrigeration systems is necessary in order to avoid build-up of ice on the evaporator side of the refrigeration system. Therefore, regular defrost is accomplished by the control mechanism of the refrigeration system during the entire operation of the refrigeration system, from start-up of the refrigeration system and during subsequent operation.

BACKGROUND

Defrost of refrigeration systems is controlled regularly during normal mode of operation. However, during first start-up of the refrigeration system and during re-start of the refrigeration system, defrost as controlled during normal mode of operation may lead to false cooling operation or lack of cooling operation of items or locations to be cooled by the refrigeration system. Therefore, during first start-up and during re-start after loss of electrical power, special modes of operation must be used for obtaining cooling and for obtaining correct cooling. Often, special modes of operation are controlled manually, or special modes of operation have to be monitored carefully by a person for ensuring subsequent cooling at all and for ensuring subsequent correct cooling.

SUMMARY

It may be seen as an object of the invention to provide a method which ensures optimized defrost operation of a refrigeration system during all operating conditions such as during start-up and as during intermediate shut-down.

The object of the invention may be obtained by a first method comprising the steps of establishing a defrost period, and when a compressor of the refrigeration system is running, monitoring a parameter representative of the compressor running, said monitoring establishing at least one parameter limit value representative of whether a defrost period or a non-defrost period is to be initiated, and if the parameter being monitored is above a parameter limit value, determining that a defrost period is not to be initiated subsequent to the compressor running, if the parameter being monitored is below a parameter limit value, determining that a defrost period is to be initiated subsequent to the compressor running.

Monitoring a parameter representative of the one or more compressors running and controlling defrost operation or non-defrost operation depending on a limit value of the parameter enables the control method to differentiate between start-up of the refrigeration system and normal operation of the one or more compressors, i.e., operation after start-up and during sequential cooling and defrosting for maintaining a certain temperature of the items or location being cooled by the refrigeration system. Start-up may be during factory testing before the refrigeration system is installed at the customer. Start-up may be just after the refrigeration system has been installed and electrical power switched on. Start-up may also be necessary after a loss of electrical power to the refrigeration system, i.e., a restart. In those situations, the one or more compressors may run for a prolonged period of time than during normal cooling operation, but defrost should not be initiated until a certain temperature is obtained of the items or location being cooled by the refrigeration system.

According to one possible aspect of the invention, the parameter limit value, when monitoring if the parameter being monitored is above a parameter limit, is the same as the parameter limit value, when monitoring if the parameter being monitored is below a parameter limit, so that no value gap is present between former and the latter parameter.

The parameter limit value may be only one limit value for both the upper limit value and the lower limit value. Monitoring only detects whether the parameter monitored is above or below said one limit value. Accordingly, there is no interval between the parameter upper limit values and the parameter lower limit value.

According to another possible aspect of the invention, the parameter limit value, when monitoring if the parameter being monitored is above a parameter limit value, is greater than the parameter limit value, when monitoring if the parameter being monitored is below a parameter limit value, so that a value gap is present between former and the latter parameter value.

The parameter limit value may be two different limit values for the upper limit value and the lower limit value, respectively. Monitoring detects whether the parameter monitored is above the upper limit value or whether the parameter is below the lower limit value. There is an interval of a certain value between the parameter upper limit values and the parameter lower limit value.

According to a first aspect of monitoring the compressor running, the at least one parameter value being representative of the compressor running is a number of compressor cycles, and if the number of compressor cycles is above an upper limit number of compressor cycles, determining that a defrost period is not to be initiated subsequent to the compressor running, and if the number of compressor cycles is below a lower limit number of compressor cycles, determining that a defrost period is to be initiated subsequent to the compressor running.

Possibly, the upper limit of compressor cycles is between 2 cycles and 100 cycles, possibly being between 2 cycles and 50 cycles, possibly being 20 cycles. Empirically, the number of compressor cycles during normal operation may be, e.g., 100 compressor cycles or less. Accordingly, a number of compressor cycles above 100 is representative of the compressor running immediately after start-up.

According to a second aspect of monitoring the compressor running, the at least one parameter value being representative of the compressor running is a temperature of the compressor, and if the temperature of the compressor is above a temperature limit, determining that a defrost period is not to be initiated subsequent to the compressor running, and if the number of compressor cycles is below a temperature limit, determining that a defrost period is to be initiated subsequent to the compressor running.

Possibly, the temperature of the compressor may be a parameter representative of the compressor running immediately after start-up. If the temperature increases to above an upper limit value, it may indicate the compressor having been running for a certain prolonged period of time as, e.g., immediately after start-up.

According to a third aspect of monitoring the compressor running the at least one parameter value being representative of the compressor running is electrical power applied to the compressor, and if the electrical power applied to the compressor is above a power limit, determining that a defrost period is not to be initiated subsequent to the compressor running, and if the electrical power applied to the compressor is below a power limit, determining that a defrost period is to be initiated subsequent to the compressor running.

Possibly, the electrical power applied to the compressor may be a parameter representative of the compressor running immediately after start-up. If the electrical power increases to above an upper limit value, it may indicate the compressor having been running for a certain prolonged period of time as, e.g., immediately after start-up.

The object of the invention may alternatively or additionally be obtained by a second method comprising the steps of establishing a safe defrost period, and when a defrost period is initiated, determining whether the defrost period is a safe defrost period, said determination being established by a temperature of at least one refrigeration system component, said temperature being representative of whether a safe defrost is to be established, said determination being established subsequent to electrical power for the refrigeration system being firstly applied or being re-applied subsequent to a possible loss of electrical power, monitoring the temperature of the refrigeration system component subsequent to electrical power being firstly applied or being re-applied subsequent to a possible loss of electrical power, with the proviso that the temperature of the at least one refrigeration system component is below an upper limit, resetting the defrost mode of operation to the defrost mode of operation prevailing before the power loss, and with the proviso that the temperature of the at least one refrigeration system component is above the upper limit, resetting the defrost mode of operation to the defrost mode of operation prevailing as when the refrigeration system initially was installed, adjusted or in any other way initially set up.

Monitoring the temperature of the refrigeration system component subsequent to electrical power being firstly applied or being re-applied subsequent to a possible loss of electrical power, and establishing a so-called safe defrost period results in defrost operation being applied correctly depending on a possibly first appliance or a re-appliance of electrical power. In such situations, safe defrost . . . .

According to one aspect of the second method, the temperature is monitored on at least one of the following components: in a refrigeration system evaporator and in a refrigeration system cabinet. Monitoring at least of the said two components is a way of ensuring that cooling by the refrigeration system of items or locations is performed in an optimized manner during cooling subsequent to first appliance or re-appliance of electrical power. The said two components of the refrigeration system may be the best components representative of the temperature of items or location being cooled.

According to another aspect of the second method, the temperature is monitored both in the refrigeration system evaporator and in the refrigeration system cabinet, and if the temperature in the refrigeration system evaporator is above the upper limit, and the temperature of the refrigeration system cabinet is below the upper limit, determining the defrost period is a non-safe defrost period. The temperature of the refrigeration system evaporator determining whether the defrost period is a safe or non-safe defrost period, and determining the defrost period is a non-safe defrost period if the temperature of the refrigeration system evaporator is above the upper limit ensures cooling of items in the refrigeration system or a location to be cooled by the refrigeration system, although the temperature of the refrigeration system cabinet is or may be below the upper limit.

BRIEF DESCRIPTION OF THE DRAWINGS

The invention will hereafter be described with reference to the drawings where.

DETAILED DESCRIPTION

The figures show possible relationships between time along the x-axis and temperature along the y-axis. There are different intervals along the x-axis, each interval representing a certain mode of operation of the refrigeration system.

Figure 1:
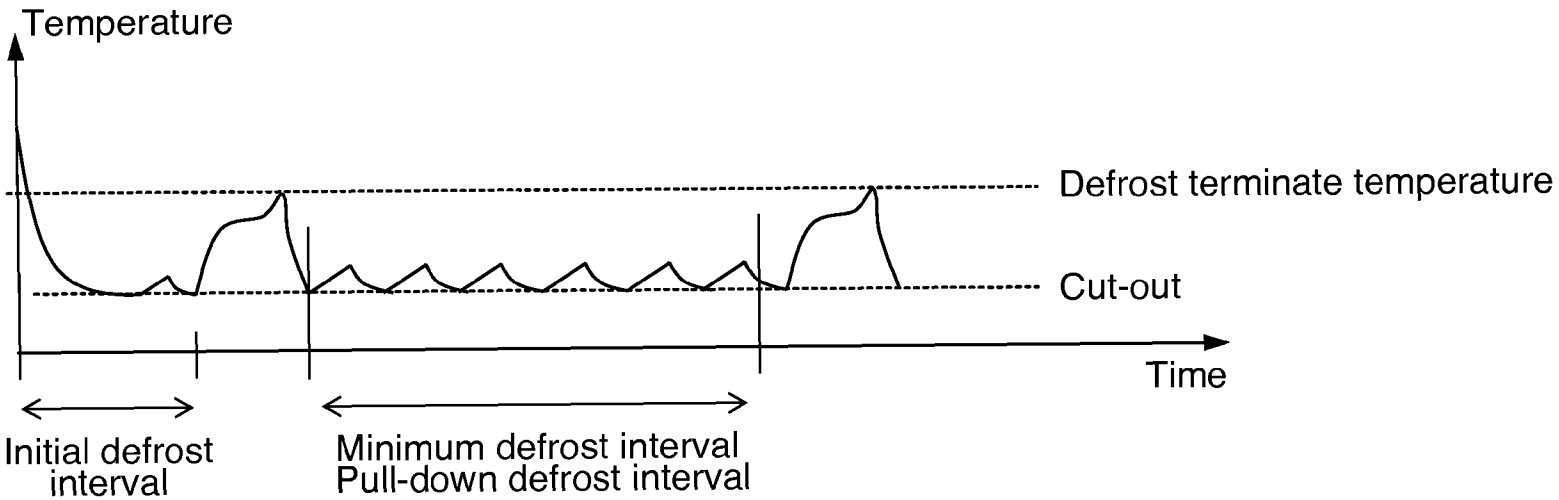
FIG. 1 is a chart showing control of a refrigeration system during so-called initial defrost.

FIG. 1 shows a chart of a mode of control during a so-called initial defrost. An initial defrost interval is used for factory testing to test that the defrost circuit works as intended. Initial defrost can be programmed to one of the following modes of control: Expire after a number of compressor cycles (initial defrost duration at a number between, e.g., 1 and 99 cycles, possibly between 1 and 998 cycles), or number of compressor cycles not used as a mode of control (initial defrost duration 0 cycles), or number of compressor cycles always used (initial defrost duration, of e.g., 100 cycles, possibly of 999 cycles)

A defrost counter is restored after power-loss, so that during normal operation the initial defrost is not needed, and in case of poor power-quality, it can lead to too often defrosting. After the initial defrost, the next defrost interval will be either a minimum defrost interval or a pull-down defrost interval.

Figure 2:
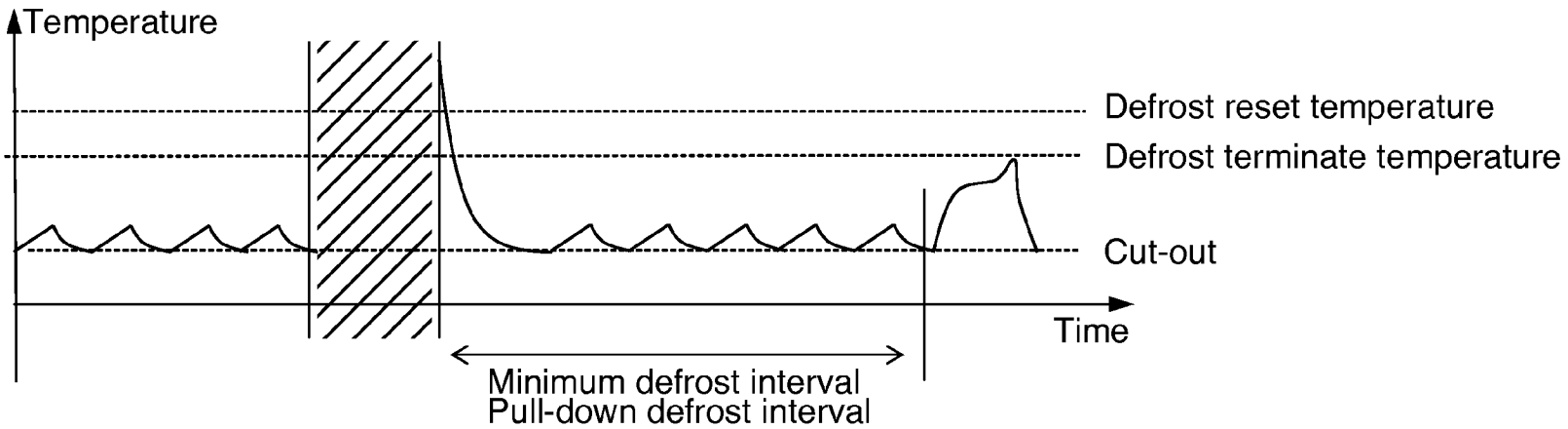
FIG. 2 is a chart showing one mode of operation of a refrigeration system after a power interruption.

FIG. 2 is a chart of one mode of control after power interruption, marked by a hatched rectangle, resulting in an intermediate power-loss. After a power-interruption, cabinet or evaporator temperature of the refrigeration system is measured and compared with a defrost reset temperature. If the temperature of the cabinet or evaporator is higher than the defrost reset temperature, it can be assumed that the evaporator is free of ice and no defrost is needed. A defrost counter is therefore reset, next defrost will happen after the minimum defrost interval, or if the control enters pull-down mode, after the pull-down defrost interval. Cut-out temperature is the temperature at which the refrigeration system is cut-out, i.e., where the refrigeration temperature as initially set is reached. Defrost terminate temperature is the temperature, where defrost is terminated, i.e., where it can be assumed that any ice formed on the evaporator has melted.

Figure 3:
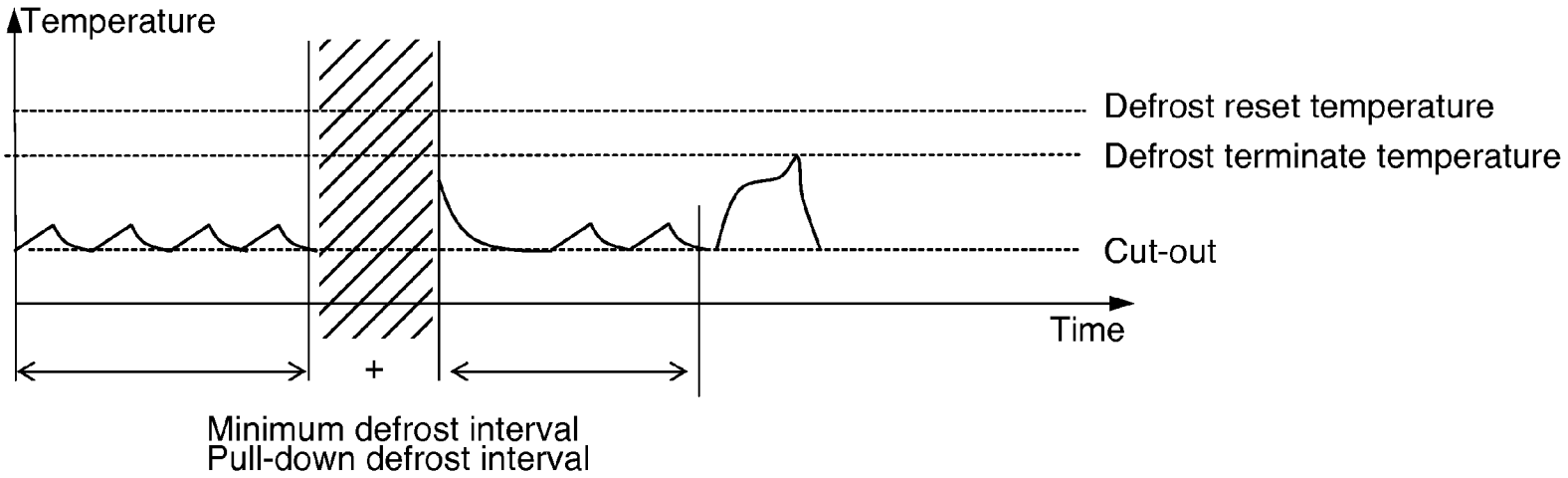
FIG. 3 is a chart showing another mode of operation of a refrigeration system after a power interruption.

FIG. 3 is a chart of another mode of control after power interruption, marked by a hatched rectangle, resulting in an intermediate power-loss. After a power-interruption, cabinet or evaporator temperature of the refrigeration system is measured and compared with a defrost reset temperature. If the temperature measure is lower than the defrost reset temperature, there is a risk of ice having formed on the evaporator, and a defrost counter will be restored and next defrost will happen after the accumulated time before and after the power-interruption. Cut-out temperature is the temperature at which the refrigeration system is cut-out, i.e., where the refrigeration temperature as initially set is reached. Defrost terminate temperature is the temperature, where defrost is terminated, i.e., where it can be assumed that any ice formed on the evaporator has melted.

The mode of operation shown in FIG. 2 and the mode of operation shown in FIG. 3, respectively, may be implemented into a control unit for each of the modes of control. Alternatively and preferably, the mode of operation shown in FIG. 2 and the mode of operation shown in FIG. 3, respectively, may be implemented into a control unit common for both of the modes of control. The one or more control units may be provided as part of a refrigeration system thus being controlled according to one, or according to both, of the modes of control as shown in FIG. 2 and FIG. 3.

Figure 4:
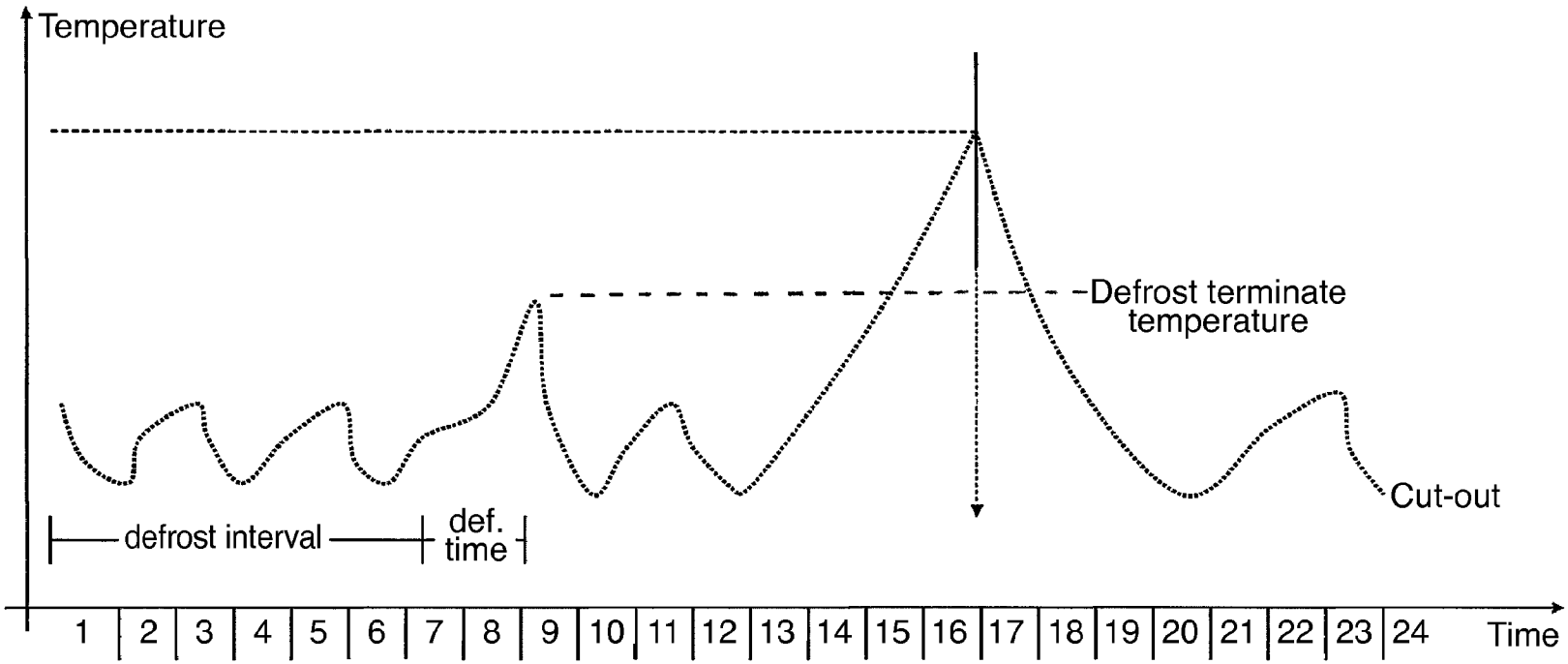
FIG. 4 is a chart showing an example of a mode of control of a refrigeration system after a power loss of certain duration and at a certain time of day.

FIG. 4 is a specific example related to the general description referred to in FIG. 2 and FIG. 3. A first interval has a duration of approximately 7 hours, extending from time zero hours to time 7 hours. The first interval is a normal mode of operation of the refrigeration system with sequential active cooling and non-active cooling. Active cooling is where the compressor is running, illustrated by the temperature decreasing until a certain lower temperature limit. The mode of operation switches to non-active cooling, when the lower temperature limit is reached. Non-active cooling is where the compressor is not running, illustrated by the temperature increasing to a certain upper temperature limit. When the certain upper temperature limit during normal mode of operation is reached, the mode of operation switches to active cooling until a certain lower temperature limit is reached and so on, i.e., a sequential active and non-active cooling of a normal mode of operation.

The upper temperature limit and the lower temperature limit during normal mode of operation is not the upper and lower temperature limits being part of the scope of the invention. Accordingly, the mode of operation shown form time zero hours to time 7 hours is not within the scope of the method according to the invention.

A second interval has a duration of approximately two hours, extending form time 7 hours to time 9 hours. The second interval is a defrost period, where control of the refrigeration system is such that the temperature is allowed to increase and to pass the upper temperature limit of the first interval. The second interval is an interval of non-active cooling. During the second interval, ice having formed on the evaporator of the refrigeration system is melting. When the temperature has increased to e certain increased temperature limit, the compressor is started to initiate active cooling.

A third interval is subsequent to the second interval, i.e., subsequent to the defrost period. The third interval is an interval where active cooling is performed, and the third interval has a duration of approximately 1 hour, from time 9 hours to time 10 hours.

The second interval and the third interval are also intervals of normal mode of operation. Accordingly, the mode of operation shown from time 7 hours to time 10 hours is not within the scope of the method according to the invention.

A fourth interval, subsequent to the third interval, is similar to the first interval. However, the fourth interval is disrupted by a loss of electrical power, said loss of electrical power happening at approximately time 13 hours.

A fifth interval, subsequent to the fourth interval, is an interval where loss of electrical power is prevailing. The refrigeration system has no electrical power to run the compressor, and therefore the temperature is constantly increasing during the fifth interval. In the diagram shown, the fifth interval has a duration of approximately 4 hours, from time 14 hours to time 17 hours. At time 17 hours, electrical power is re-applied and the compressor may run again to provide cooling.

A sixth interval, subsequent to the fifth interval, is where the compressor is running again, after electrical power has been re-applied. Cooling is performed to a lower temperature limit similar to the lower temperature limit as set in the first interval. The fifth interval has a duration of approximately 3½ hours, from time 17 hours to time 20½ hours. When the compressor has been running for approximately 3 hours, the temperature has decreased to a lower temperature limit similar to the lower temperature limit as set in the first interval.

A seventh interval, subsequent to the sixth interval, is where normal mode of operation is re-established, the seventh interval being similar to the first interval. The seventh interval ends at 24 hours, i.e., after a full day, and the seventh interval leads to start of the first interval.

As mentioned, the seventh interval is an interval of normal mode of operation. Accordingly, the mode of operation shown from time 20½ hours to time 24 hours is not within the scope of the method according to the invention.

An upper temperature limit, X°, and set in accordance to the method of the invention, is set between the fifth interval and the seventh interval, i.e., the upper temperature limit, X°, is set between the interval where loss of electrical power is prevailing and the interval where electrical power is re-applied to the refrigeration system.

If the temperature during the fifth interval increases to a temperature only below the upper temperature limit, X°, the control of the defrost mode of operation as applicable during the first interval is saved for future intervals of normal mode of operation. Saving the defrost timer is possible because the temperature increase during the fifth interval is only below the upper temperature limit, X°.

Therefore, the defrost timer as applicable during the first interval may be used in intervals subsequent to the fifth interval and sixth interval, although the compressor may run for a prolonged period of time during the sixth interval, compared to the period of time when the compressor is running during active cooling in the first interval. The prolonged period of time is for decreasing the temperature to a lower temperature limit similar to that of the first interval.

If the temperature during the fifth interval increases to a temperature above the upper temperature limit, X°, the control of the defrost mode of operation as applicable during the first interval cannot be used for future intervals of normal mode of operation. Therefore, the defrost timer has to be reset to a timer condition similar to a first start-up of the refrigeration system, because the temperature increase during the fifth interval is above the upper temperature limit, X°.

As mentioned, the defrost timer as applicable during the first interval cannot be used for intervals subsequent to the fifth interval and sixth interval, because the compressor will run for a period of time resembling a first start of the refrigeration system. In order to decrease the temperature to a lower temperature limit similar to that of the first interval, the defrost timer applicable in the first interval must be overruled by the control of the refrigeration system, allowing the compressor to run for a much longer prolonged period of time, compared to the period of time when the compressor is running during active cooling in the first interval. The even longer prolonged period of time is a period of time more resembling the compressor running like during first start of the refrigeration system than a period of time where the compressor is running like during active cooling in the first interval. First start of the refrigeration system will normally take place form a temperature above the upper temperature limit X°.

Although various embodiments of the present invention have been described and shown, the invention is not restricted thereto, but may also be embodied in other ways within the scope of the subject-matter defined in the following claims.

What is claimed is:

1. A method for controlling a refrigeration system, said method comprising the steps of:

establishing a defrost period, and when the defrost period is initiated, determining whether the defrost period is a safe defrost period, said determination being established by a temperature of an evaporator of the refrigeration system, said evaporator temperature being representative of whether a reset of a defrost mode of control is to be established, said determination being established subsequent to electrical power for the refrigeration system being firstly applied or being re-applied subsequent to a possible loss of electrical power, monitoring the evaporator temperature with a temperature monitoring device disposed at the evaporator of the refrigeration system, subsequent to electrical power being firstly applied or being re-applied subsequent to the possible loss of electrical power, with a proviso that the evaporator temperature is below an upper limit, resetting the defrost mode of operation to the defrost mode of operation prevailing before the power loss, and with a proviso that the evaporator temperature is above the upper limit, resetting the defrost mode of operation to the defrost mode of operation prevailing as when the refrigeration system initially was installed, adjusted or in any other way initially set up.

2. The method according to claim 1, and with the proviso that the evaporator temperature is below the upper limit, and subsequent to resetting the defrost mode of operation to the defrost mode of operation prevailing before the power loss, initiating a subsequent defrost of the refrigeration system after a minimum defrost interval has elapsed or, if the refrigeration system has entered a pull-down mode, after a pull-down defrost interval has elapsed.

3. The method according to claim 1, and with the proviso that the evaporator temperature is above the upper limit, and subsequent to resetting the defrost mode of operation to the defrost mode of operation prevailing as when the refrigeration system initially was installed, adjusted or in any other way initially set up, initiating a subsequent defrost of the refrigeration system after an accumulated period of time both before and after the loss of electrical power.

4. The method according to claim 1, further comprising the step of monitoring a temperature of a cabinet of the refrigeration system, and wherein if the evaporator temperature is above the upper limit, and the cabinet temperature is below the upper limit, determining the defrost period is a non-safe defrost period.

5. A control unit for controlling a refrigeration system, said control unit capable of controlling the refrigeration system according to claim 1.

* * * * *